United States Patent [19]

Rasmussen

[11] 3,968,541

[45] July 13, 1976

[54] PROCESS FOR MANUFACTURING FIRE-RETARDANT COTTON FELT

[76] Inventor: Emil B. Rasmussen, 10408 Newville Ave., Downey, Calif. 90241

[22] Filed: Sept. 4, 1974

[21] Appl. No.: 503,106

[52] U.S. Cl. ..... 19/66 R; 28/75 R

[51] Int. Cl.[2] ..... D01G 15/06; D01G 29/00; D01G 37/00

[58] Field of Search..... 28/75 R; 117/138, 100 A, 117/143 B; 161/170; 19/66 R

[56] References Cited

UNITED STATES PATENTS

| | | | |
|---|---|---|---|
| 148,826 | 3/1874 | Howe | 19/66 R |
| 149,085 | 3/1874 | Wilkinson | 19/66 R |
| 865,033 | 9/1907 | Haley | 117/138 |
| 1,642,092 | 9/1927 | Smith | 117/100 A UX |
| 1,982,381 | 11/1934 | Hayes-Gratze | 28/75 R |
| 2,185,695 | 1/1940 | Oliver | 117/138 |
| 3,013,525 | 12/1961 | Fuller et al. | 117/100 A X |
| 3,102,835 | 9/1963 | White | 28/75 R X |
| 3,629,052 | 12/1971 | Knoepfler et al. | 28/75 R X |
| 3,738,958 | 6/1973 | Paul, 3rd | 161/170 X |
| 3,837,903 | 9/1974 | Jones | 117/138 |

FOREIGN PATENTS OR APPLICATIONS

| | | | |
|---|---|---|---|
| 1,349,907 | 12/1963 | France | 117/138 |

*Primary Examiner*—Robert R. Mackey
*Attorney, Agent, or Firm*—Fitch, Even, Tabin & Luedeka

[57] ABSTRACT

The process of producing a fire-retardant cotton felt for upholstery purposes by intermixing boric acid powder with the cotton fibers on the clothing of the rolls of the garnett.

2 Claims, 1 Drawing Figure

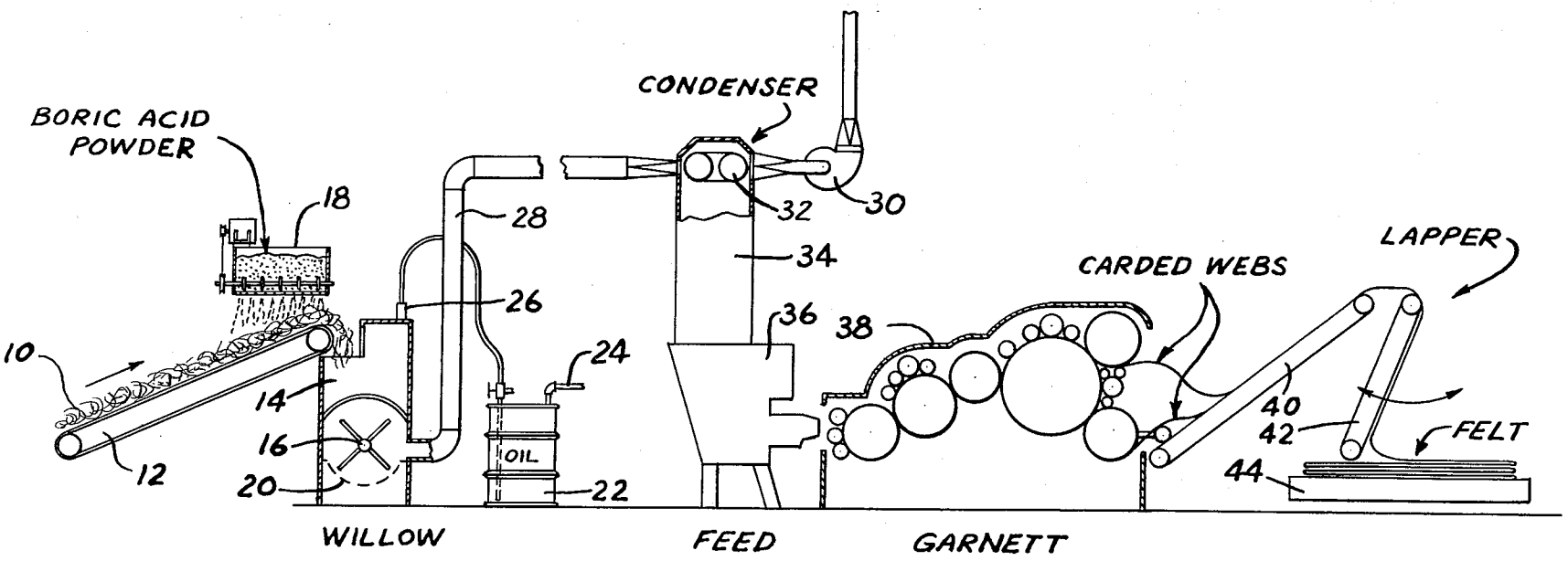
LAPPER
FELT
40
42
44
CARDED WEBS
GARNETT
38
30
32
34
36
CONDENSER
FEED
24
22
OIL
28
26
WILLOW
18
14
16
20
BORIC ACID POWDER
12
10

PROCESS FOR MANUFACTURING FIRE-RETARDANT COTTON FELT

This invention relates generally to the manufacture of fire-retardant upholstery materials, and in particular to the treatment of cotton felt with fireproofing materials during the process of manufacture to produce a cotton felt which, when incorporated into mattresses, will enable the mattress to meet the federal Flammability Standards for Mattresses, in particular, to pass the so-called "cigarette test".

To meet the mattress flammability standards which were promulgated under the Flammable Fabrics Act of 1953, as amended, and which went into effect in the latter part of 1973, newly manufactured mattresses selected at random must successfully withstand the ignition effect of a burning cigarette laid upon the surface of the mattress. Specifically, the cigarette must burn itself through without having ignited the mattress material and without any evidence of afterglow, i.e., sustained flameless burning, of either the textile fibers of the mattress cover or of the padding of the upholstery, and without having charred these materials for a distance greater than one inch from the outline of the cigarette.

For many years, in the manufacture of mattresses and other upholstered furniture in the United States, particularly prior to the introduction of polyurethane cushion foam, cotton felt, being widely available at reasonable prices, was the most extensively used padding material for upholstery purposes. Cotton fibers, however, are flammable in their natural state, and when otherwise untreated to resist ignition, felts of cotton fibers, or predominantly of cotton fibers, in natural state have not been able to withstand the rigorous requirements imposed by the standards promulgated under the Federal Flammable Fabrics Act.

As a result, the utilization of this widely available fiber material became limited in upholstery applications to use with protective overpads of materials which were able to withstand the cigarette test. This had the multiple effect of complicating the manufacture of mattresses, raising the prices of the same to the ultimate consumer, and curtailing the use of the heretofore widely-used natural cotton fibers for mattress upholstery purposes.

It is the object of this invention to again make the natural and relatively inexpensive cotton fiber available as a finishing upholstery material by rendering the same capable, at relatively slight cost, of meeting the federal flammability standards and, in particular, enabling mattresses manufactured with such cotton felt as the primary or finish upholstery padding material capable of withstanding the aforementioned stringent cigarette test.

It is a further object of the invention to accomplish an effective fire-retardant treatment of natural cotton fibers by the addition thereto of boric acid in a powdered state during the manufacture of the felt and in a manner such as will distribute the boric acid upon or among the cotton fibers so as to enable them to retain their initial resistance to ignition over an extended period notwithstanding the mechanical working of the cotton felt which results inevitably from handling it, as felt, before and during the manufacture of mattresses, and from the ordinary shipment and use of the finished product.

It is a further object of the invention to perform the fire-retardant treatment of cotton felt without requiring either a large capital investment or the dislocation of the substantial capital investments which have already been made in equipment long developed and traditionally used for making felt. In short, the invention seeks to put cotton back to work as the effective upholstery material it always had been in the manufacture of low and medium priced innerspring mattresses, and thus to serve the necessities and comfort of the greatest number of ordinary people within the federal flammability requirements.

The ability of boric acid and other derivatives of the naturally-occurring borax to elevate the ignition temperatures of ordinarily flammable materials is well-known and is no part of my invention or discovery. My invention relates rather to the technique of incorporating these known fire-retardant materials with the natural fibers in the process of the manufacture of felt therefrom so as to enable the felt, and mattresses and other furniture products manufactured therefrom, to demonstrate fire-retardancy to the degree required by law.

By my process, the borax derivative is incorporated in a dry, powdered state into the natural fibers in the course of their fabrication into cotton felt by the traditional garnetting process. It is done, however, in such a way that the fireproofing material becomes intimately associated with the cotton fibers and is not separable therefrom by normal mechanical working in any degree sufficient to detract from the protective function of the added material.

In particular, I have found that the introduction of boric acid into the traditional garnetting process at a point which subjects the boric acid to intimate interworking with the cotton fibers in the garnett serves to fix the fire retardant material to the fibers. As the fibers are literally torn from each other and re-intertwined in the garnetting process, the boric acid powder becomes intimately associated with the fibers to a degree such that powdered material can not be seen by the naked eye in the finished felt and is not physically dissociable therefrom by vibration or other mechanical working. It is my belief that this intimate association of the fire-retardant material with the fibers will provide extended fire-retardancy over long periods, as contrasted, for example, with the mere dusting of the powdered fire-retardant material upon a completed, carded web as it leaves the garnett.

In the accompanying drawing I have illustrated in a diagrammatic flowsheet the rudimentary elements of a cotton felt manufacturing line such as would be used for the manufacture of cotton felt for mattresses.

In the drawing, the material flow is from left to right and commences with the introduction of cotton 10 in clumps or clods as torn from an opened bale. Cotton felt for upholstery purposes is usually made as a mixture of long-fibered so-called "pickers" and short-fibered so-called "linters" in a variable ratio commonly or nominally about 25% pickers to 75% linters. In such a mixture, the short-fibered linters provide "body" whereas the long fibered pickers knit the mass together as a unified whole.

In the drawing, the first material handling device is an endless-belt feed conveyor 12 upon which the cotton in roughly broken form is deposited in any convenient way by the attendant, and in the approximate proportions earlier described. The cotton deposited upon the feed conveyor is carried up to the feed opening of the willow 14 from which it drops upon the rotating agitator 16 in the willow. Immediately above the feed conveyor 10, I have placed the boric acid feed bin 18, which serves to store a working quantity of boric acid and also to meter the flow of the powdered material which falls by gravity from the feed bin onto the cotton travelling up the feed conveyor. The boric acid feed bin resembles a fertilizer spreader, i.e., a V-shaped open trough with metering holes at the bottom which are cleared by a motor-driven agitator extending along the bottom of the trough.

In the willow, which is essentially an elongated box, the clumps of cotton are broken and fluffed and the two kinds of fibers are mixed by agitator 16 which is an elongated shaft with numerous paddles extending radially therefrom. In addition to beating the fibers, the agitator gradually conveys the contents introduced at one end of the willow toward the opposite or delivery end, the box frame of the willow providing essentially an enclosure for the elongated agitator. The fluffing and throwing action of the agitator dislodges from the cotton much of the dirt which baled cotton inevitably contains, and the dirt, being heavier than the fibers, settles to the bottom of the willow, falling through a screen 20 provided for that purpose.

It is common practice to introduce into the cotton in the willow a spray of dusting oil which serves to hold in the product much of the fine cotton dust, i.e., the minute pieces of cotton fiber which are inevitably broken off by the mechanical working of the cotton fibers in the willow and also in subsequent operations on the garnett. The dusting oil I commonly use is a relatively light petroleum distillate which Standard Oil Company of California markets as Blending Oil No. 50, and which I have also obtained from Arco under their specification No. S-105.

The dusting oil is delivered to he willow from a 55-gallon drum 22 which the pressurized from an air line 24 to deliver the dusting oil under pressure to the nozzle 26 in the willow. From usage figures, I found that I normally use about ½ gallon of dusting oil per thousand pounds of cotton processed through the system when making conventional cotton felt, whereas for the manufacture of fire-retardant felt, using boric acid, I have found it advisable to double that amount to help to retain the boric acid powder with the cotton as the latter travels through the duct work to the garnett.

The boric acid which I use is a standard technical grade which United States Borax and Chemical Corporation defines as "Powdered Technical Boric Acid". Their published specifications for the product indicate the following screen sizes by percentage:

| Sieve No. | Percent |
|---|---|
| 100 | 0.5% |
| 140 | 2 |
| 200 | 6 |
| 325 | 28 |
| −325 | 72 |

The amount of boric acid used is approximately 12% by weight of the raw cotton fed to the willow.

The cleaned, fluffed and mixed cotton is drawn from the willow through a conduit 28 in a stream of air induced by a centrifugal fan 30 which serves the purpose of conveying the mixed cotton fibers with the entrained boric acid from the willow to the garnett. At the location of the garnett in the accompanying flowsheet drawing, the cotton as thus far treated is separated from the air stream by a filtering device 32 commonly called a "condenser", comprising rotating perforated drums, the interiors of which are connected to the intake of the centrifugal fan and which function therefore as a vacuum filter. As the drums rotate, the accumulated filter cake is scraped from the condenser drums and falls through a chute 34 into the hopper 36 of the garnett 38.

In the garnett, the cotton mixture from the feed hopper is intimately worked by a carding process in which the fibers are torn and intermixed, and further torn and further intermixed, to ultimately produce a gossamer-thin carded web which is doffed from the exiting rolls of the garnett machine. In the illustrated case, the garnett is shown as a double-doffing type, i.e., producing two webs, one upper and one lower, which are laid upon each other on an inclined, rising endless slat-conveyor 40, and transferred to a lapping conveyor 42 which lays the double carded web sinuously upon a cross-conveyor moving perpendicularly to the direction of flow of material from the lapper.

In a large installation, the outputs of a number of garnetts, say four or five, might all be laid upon the same cross-conveyor to accumulate the simultaneously laid carded webs into a felt of substantial thickness.

When the boric acid is introduced in the early stages of the garnetting process, as for example into the willow as earlier specifically described, the presence of the boric acid as a constituent of the through-flowing felt becomes readily apparent by the coloration of the rolls of the garnett. The "cloth" of these rolls, which serve to tear the cotton fiber-from-fiber and to reassemble the fibers in a very thin "see-through" web, becomes whitened, indicating presence of the boric acid powder. In the garnetted web, however, as it is doffed from the garnett, and later, after the web has been lapped to form the felt, the boric acid cannot be detected by the naked eye.

These observations have led me to conclude that the intimate interworking of the fibers on the cloth of the garnett in the presence of the boric acid powder which they have carried into the garnett, results in a mechanical association of the boric acid powder with the cotton fibers that is too intimate to detect by ordinary visual observation. It is my conclusion that this intimate association achieved by the mechanical working of the fibers upon the cloth of the garnett rolls is attributable largely to the presence of naturally occurring adhesive coating of a waxy character on the cotton fiber which is perhaps activated by the intensity of the working of the fibers in the garnett. I am uncertain as to what degree, if any, the dusting oil contributes to the final result over and above its function of improving the transportation of the powdered boric acid to the garnett, i.e., whether it enters directly into the distribution and adhesion process or whether it merely enhances the ability of the naturally occurring, fiber coating materials to combine with and retain the boric acid in close association with the fiber.

In any event, the adhesion of the boric acid to the cotton fibers is obviously excellent and the amount of boric acid which can be dislodged from my felts, made as above-described, is negligible. Mattresses made with this felt have been massaged through many thousands of cycles by "juggernaut" rollers, i.e., flat sided "rollers" such as are normally used for accelerated life-testing of mattresses, without impairing the ability of mattresses constructed with my felt to meet the federal standards of flammability.

The fire protection of otherwise ordinary cotton felt by this process has the obvious effect of re-establishing cotton felt as an effective and competitive upholstery padding material with a relatively minor investment of capital to the obvious advantage of the felt manufacturer and to the manufacturer-users of such felt, while at the same time, rejuvenating an important older market for cotton pickers and linters. But most importantly, it makes available once again a proven, effective, and inexpensive upholstery ingredient which had been widely used, particularly in lower-priced mattresses, but which was forced into disuse by the flammability laws.

As compared with the introduction of boric acid or other borax derivatives as fireproofing agents by other methods, e.g., immersion or spray treatment with borate solutions, the above-disclosed system has the obvious advantage of the elimination of any need for the considerable quantities of energy that are required to drive off the solvent. As compared with other techniques which have been developed to dust the carded web as it leaves the garnett, the above-described system has the product advantage of the association of the boric acid with the cotton fibers so intimately as to assure its maintenance despite intense mechanical working of the felt. From a processing standpoint, it can have a further advantage from the early introduction of the boric acid during the fiber blending process, i.e., that of being able to service a multiplicity of garnetts by the use of a single boric acid administering device located in the material flow upstream from the point at which distribution of the blended cotton to the several garnetts is made.

The features of the invention believed new and patentable are set forth in the following claims:

1. The method of manufacturing fire-retardant cotton felt by a continuous garnetting process which comprises adding powdered boric acid to raw cotton fiber in a metered flow at the rate of approximately 12% by weight of the raw cotton and making the introduction at a point in the material flow prior to garnetting to achieve substantial mechanical working of the boric acid into association with the natural coating of the raw cotton fibers on the carding cloth of the garnett rolls.

2. The method of claim 1 in which approximately one gallon of dusting oil per thousand pounds of raw cotton is also added to the cotton and in which the additions both of the powdered boric acid and of the dusting oil are made before the cotton enters the garnett.

* * * * *